US008177530B2

(12) United States Patent
Horng et al.

(10) Patent No.: US 8,177,530 B2
(45) Date of Patent: May 15, 2012

(54) MINIATURE HEAT-DISSIPATING FAN

(75) Inventors: Alex Horng, Kaohsiung (TW); Tso-Kuo Yin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 756 days.

(21) Appl. No.: 12/271,960

(22) Filed: Nov. 17, 2008

(65) Prior Publication Data

US 2010/0098560 A1 Apr. 22, 2010

(30) Foreign Application Priority Data

Oct. 17, 2008 (TW) ..... 97139847 A

(51) Int. Cl.
*F04B 35/04* (2006.01)
*H02K 21/12* (2006.01)

(52) U.S. Cl. ..... 417/423.7; 310/156.32; 310/156.33

(58) Field of Classification Search ..... 417/352, 417/423.1, 423.7; 310/156.32–156.37, 268
See application file for complete search history.

(56) References Cited

U.S. PATENT DOCUMENTS 4,164,690 A * 8/1979 Muller et al. ..... 318/400.41
4,958,098 A * 9/1990 Sarraf ..... 310/156.32
5,666,011 A * 9/1997 Hong ..... 310/40.5
5,832,986 A * 11/1998 Kenny et al. ..... 165/80.3
6,462,441 B1 * 10/2002 Horng et al. ..... 310/67 R
6,544,011 B2 4/2003 Hsieh
7,553,136 B2 * 6/2009 Ku et al. ..... 417/423.7
2007/0114868 A1 5/2007 Horng et al.
2007/0222331 A1 9/2007 Horng et al.
2008/0130169 A1 * 6/2008 Kitamura ..... 360/99.08

FOREIGN PATENT DOCUMENTS

CN 101060766 10/2007
TW I293106 11/1994
TW 200828735 A 7/2008

* cited by examiner

*Primary Examiner* — Devon C Kramer
*Assistant Examiner* — Peter J Bertheaud
(74) *Attorney, Agent, or Firm* — Alan Kamrath; Kamrath IP Lawfirm, PA

(57) ABSTRACT

A miniature heat-dissipating fan includes a stator and a rotor. The stator has a first leakage flux absorber, a coil layer arranged on the first leakage flux absorber, and a hole. The coil layer has a plurality of coils, and the hole passes through the first leakage flux absorber and the coil layer. The rotor has an impeller, a second leakage flux absorber and a permanent magnet. The second leakage flux absorber and the permanent magnet are attached to a bottom of the impeller, such that the rotor is rotatably coupled to the stator. Consequently, magnetic flux leakage under the stator is prevented to assure that electromagnetic interference will never be caused, and an overall axial thickness of the miniature heat-dissipating fan is reduced by the configuration of the stator.

5 Claims, 11 Drawing Sheets

MINIATURE HEAT-DISSIPATING FAN

CROSS REFERENCE

The application claims the benefit of Taiwan application serial No. 97139847, filed Oct. 17, 2008, the subject matter of which is incorporated herein by reference.

BACKGROUND OF THE INVENTION

1. Field of the Invention

The present invention relates to a heat-dissipating fan and, more particularly, to a miniature heat-dissipating fan that includes a stator having a reduced axial thickness.

2. Description of the Related Art

A conventional heat-dissipating fan is described in China Patent Publication No. 101060766 (with Application No. 200610072272.8) entitled "SMALL HEAT-DISSIPATING DEVICE". Referring to FIGS. 1 and 2, the conventional heat-dissipating fan 8 includes a casing 81 defining a compartment 811 and a lid 82 mounted on a top of the casing 81. A circuit board 83 and coils 84 are mounted to a base 812 delimiting a bottom of the compartment 811. An axial tube 813 extends from a center portion of the base 812, with an impeller rotor 86 being coupled rotatably in the compartment 811 by the axial tube 813. Furthermore, at least two positioning members 85 are provided on the base 812 and located outside the axial tube 813. As shown in FIG. 2, a magnet 861 and a metal ring 862 are fixed to a bottom surface of the impeller rotor 86, with the metal ring 862 being sandwiched between the impeller rotor 86 and the magnet 861. In use, the coils 84 are provided with an electric current to generate flux linkage between the coils 84 and the magnet 861, such that the impeller rotor 86 is driven by the excited coils 84 to rotate. Hence, the conventional heat-dissipating fan 8 can be mounted to an electronic device or electronic apparatus and dissipate heat generated by said electronic device or electronic apparatus.

Nevertheless, said conventional heat-dissipating fan 8 has several drawbacks as follows:

First, the metal ring 862 provides a leakage flux absorbing effect during rotation of the impeller rotor 86 that is driven by alternating magnetic fields generated by the coils 84. However, the metal ring 862 only can prevent an occurrence of magnetic flux leakage above the coils 84 and the magnet 861. Thus, magnetic flux that is generated by the coils 84 and doesn't react with the magnet 861 results in magnetic flux leakage under the coils 84 to cause electromagnetic interference (EMI), so that functions of the electronic device or electronic apparatus may easily be affected.

Second, the current trend of research and development in electronic products is miniaturization. However, the circuit board 83 and the coils 84 both have fixed axial thicknesses, which lead to a difficulty in reducing the entire axial thickness of the conventional heat-dissipating fan 8. As a result, minimizing dimensions of the conventional heat-dissipating fan 8 is not feasible, so that it is hard to apply the conventional heat-dissipating fan 8 to a miniature electronic device or electronic apparatus.

Another conventional heat-dissipating fan, Taiwan Patent Issue No. 1293106 entitled "THIN TYPE FAN", is illustrated in FIGS. 3 and 4. The conventional heat-dissipating fan 9 includes a base plate 91 having an axial hole 911 and a plurality of stator coils 912, a flat-type impeller 92 having a series of bent vanes 921, a magnet sheet 93 attached to a bottom of the flat-type impeller 92, and a shaft member 94. One end of the shaft member 94 extends into the axial hole 911 of the base plate 91, and the other end of the shaft member 94 is fixed to the flat-type impeller 92. Therefore, the conventional heat-dissipating fan 9 can be mounted to an electronic device or electronic apparatus to provide a heat dissipating effect.

However, owing to the fixed axial thicknesses of the base plate 91 and the stator coils 912 of the conventional heat-dissipating fan 9, it is difficult to reduce the entire axial thickness of the conventional heat-dissipating fan 9, too. Also, a difficulty of minimizing dimensions of the conventional heat-dissipating fan 9 is caused, and, thereby, the conventional heat-dissipating fan 9 is hard to be mounted to a miniature electronic device or electronic apparatus. Hence, there is a need for an improvement over the conventional heat-dissipating fan.

SUMMARY OF THE INVENTION

It is therefore the primary objective of this invention to provide a miniature heat-dissipating fan that overcomes the problems of the prior art described above to avoid electromagnetic interference effectively and reduce an overall thickness of the miniature heat-dissipating fan.

A miniature heat-dissipating fan according to the preferred teachings of the present invention includes a casing, a stator and a rotor. The casing defines a compartment and has a shaft tube in the compartment, an air inlet and an air outlet. The air inlet and the air outlet both connect to the compartment. The stator is disposed in the compartment of the casing and has a first leakage flux absorber, a coil layer with a plurality of coils, and a hole. The coil layer is arranged on the first leakage flux absorber. The hole passes through the first leakage flux absorber and the coil layer. The rotor has an impeller, a second leakage flux absorber and a permanent magnet. The second leakage flux absorber and the permanent magnet are both attached to a bottom of the impeller. The impeller has a shaft passing through the hole of the stator and being rotatably inserted in the shaft tube of the casing. Accordingly, by arrangement of the first leakage flux absorber, magnetic flux leakage under the stator is prevented to avoid electromagnetic interference, and an axial thickness of the stator is reduced.

In an example, a flange is formed on an outer edge of the first leakage flux absorber of the stator and surrounds the coil layer. Accordingly, magnetic flux leakage around an outer edge of the coil layer is prevented effectively to enhance a leakage flux absorbing effect of the first leakage flux absorber.

In an example, an annular wall is formed on an outer edge of the first leakage flux absorber of the stator to define an air inlet, an air outlet and a compartment, with the first leakage flux absorber having a shaft tube in the compartment and the coil layer being mounted around the shaft tube. Accordingly, the rotor can be directly received in the compartment of the first leakage flux absorber, with the shaft of the rotor being rotatably inserted in the shaft tube of the first leakage flux absorber. Thus, the casing which is mentioned above can be omitted and replaced with the first leakage flux absorber to allow a simplified structure for assembly.

In an example, each coil has an outer side away from a center of the first leakage flux absorber, with a radius of the first leakage flux absorber being larger than a distance from the center of the first leakage flux absorber to each of the outer sides. Accordingly, the first leakage flux absorber is able to completely cover the coils to avoid magnetic flux leakage effectively.

In an example, each coil has a center point, with a radius of the first leakage flux absorber being larger than a distance from a center of the first leakage flux absorber to each of the center points. Accordingly, magnetic flux leakage from the coils is effectively prevented by the first leakage flux absorber to avoid electromagnetic interference, and size of the first leakage flux absorber is reduced.

In an example, a printed circuit board is attached to a surface of the first leakage flux absorber, and the coil layer is formed on the printed circuit board by layout. Accordingly, an axial thickness of the stator is reduced.

Further scope of the applicability of the present invention will become apparent from the detailed description given hereinafter. However, it should be understood that the detailed description and specific examples, while indicating preferable embodiments of the invention, are given by way of illustration only, since various modifications will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
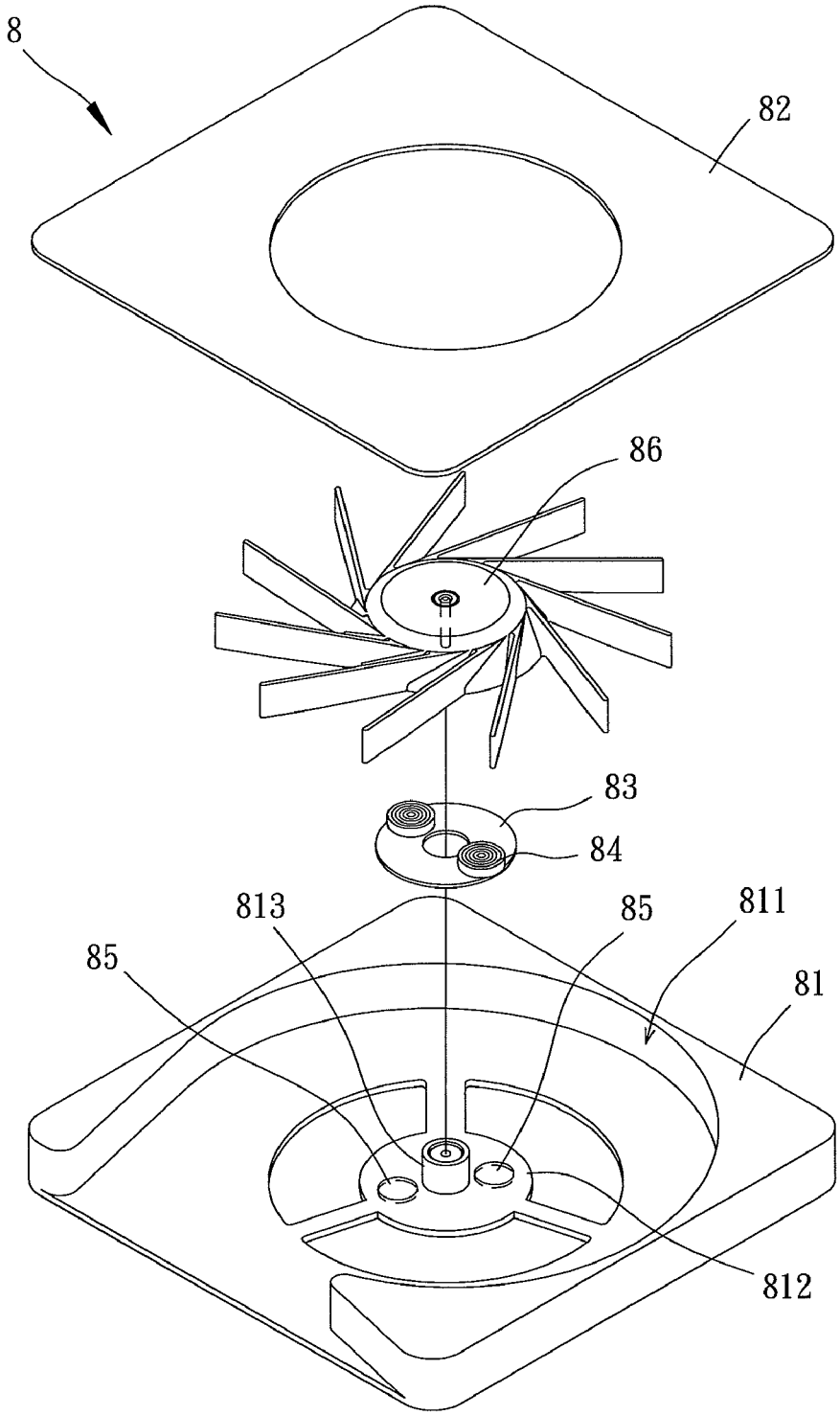
FIG. 1 PRIOR ART
FIG. 1 is an exploded perspective view illustrating a first conventional miniature heat-dissipating fan.
Figure 2:
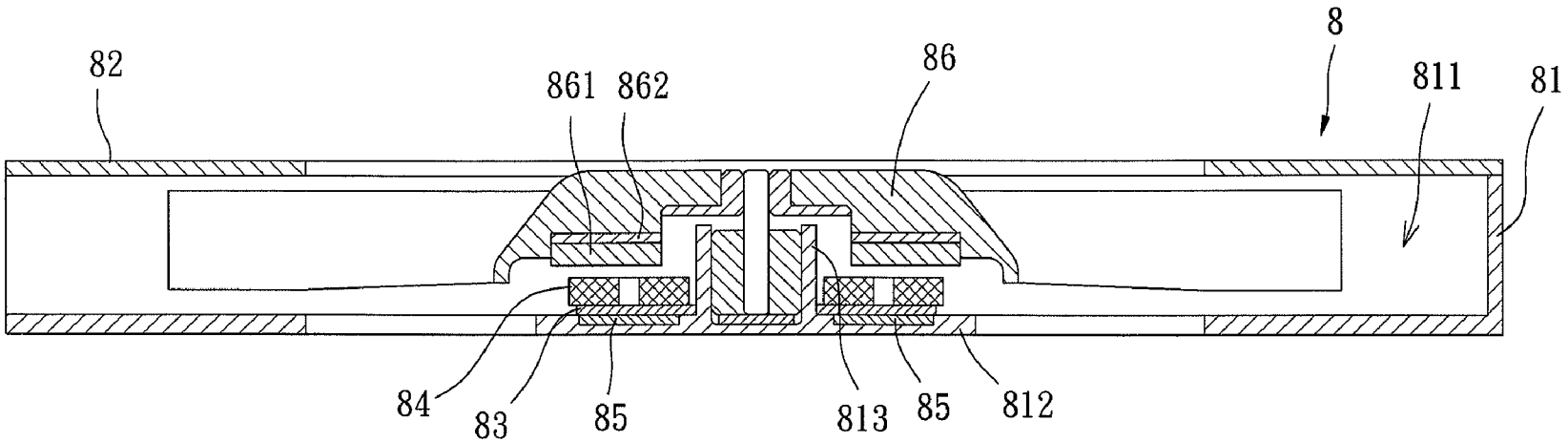
FIG. 2 PRIOR ART
FIG. 2 is a cross sectional view illustrating the first conventional miniature heat-dissipating fan.
Figure 3:
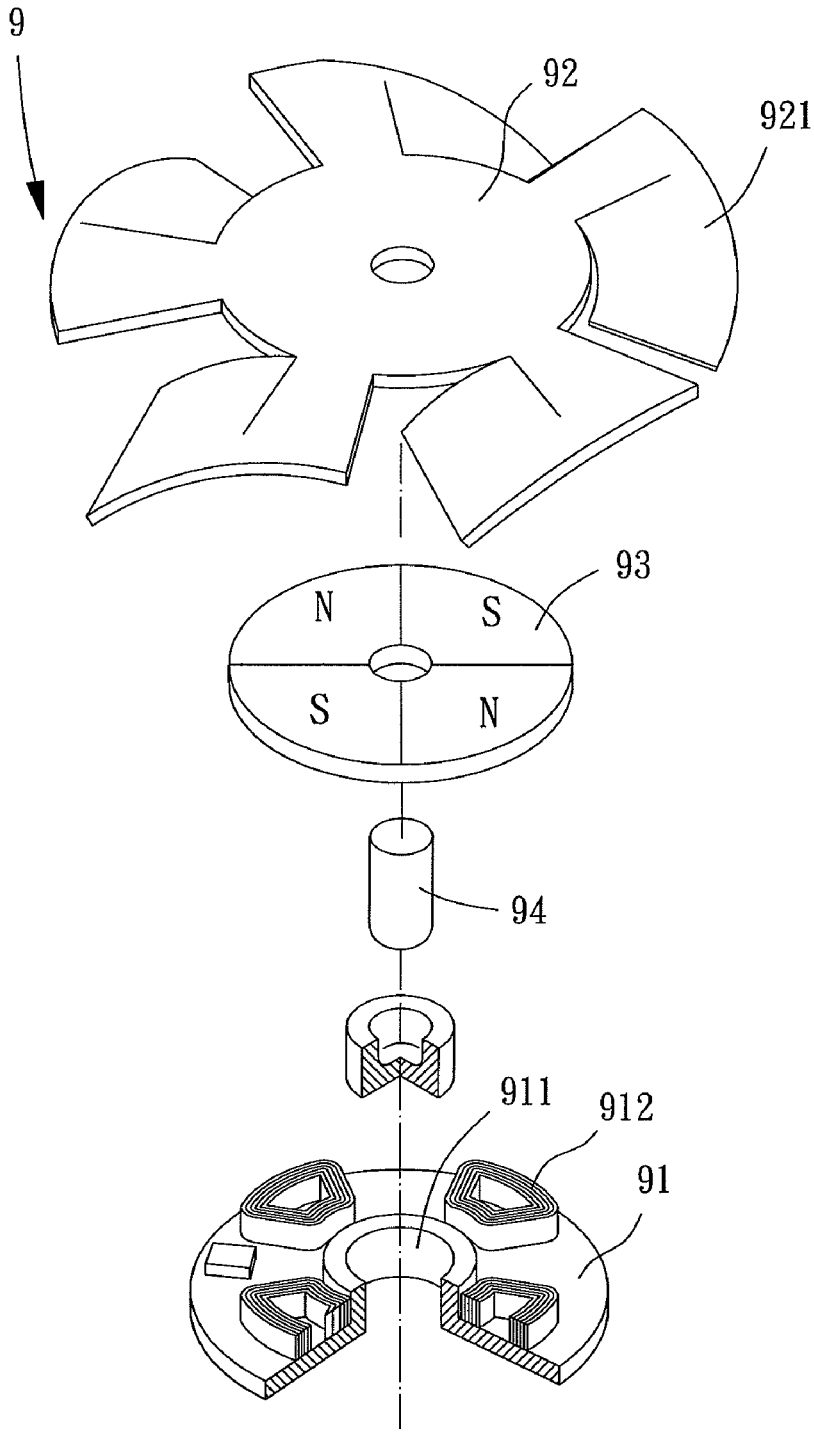
FIG. 3 PRIOR ART
FIG. 3 is an exploded perspective view illustrating a second conventional miniature heat-dissipating fan.
Figure 4:
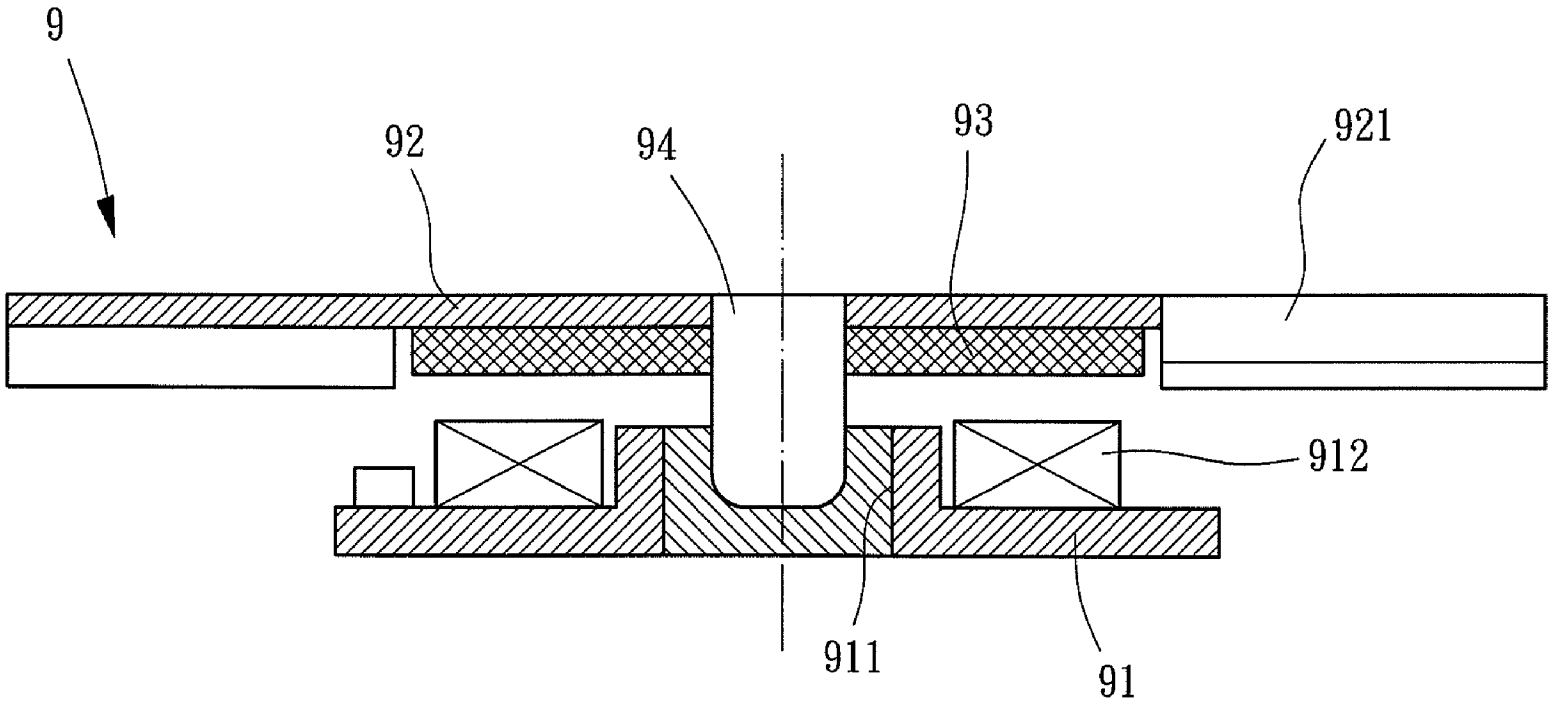
FIG. 4 PRIOR ART
FIG. 4 is a cross sectional view illustrating the second conventional miniature heat-dissipating fan.

In the various figures of the drawings, the same numerals designate the same or similar parts. Furthermore, when the terms "first", "second", "annular", "axial", "outer", "upwards" and similar terms are used hereinafter, it should be understood that these terms have reference only to the structure shown in the drawings as it would appear to a person viewing the drawings and are utilized only to facilitate describing the invention.

DETAILED DESCRIPTION OF THE INVENTION

Figure 5:
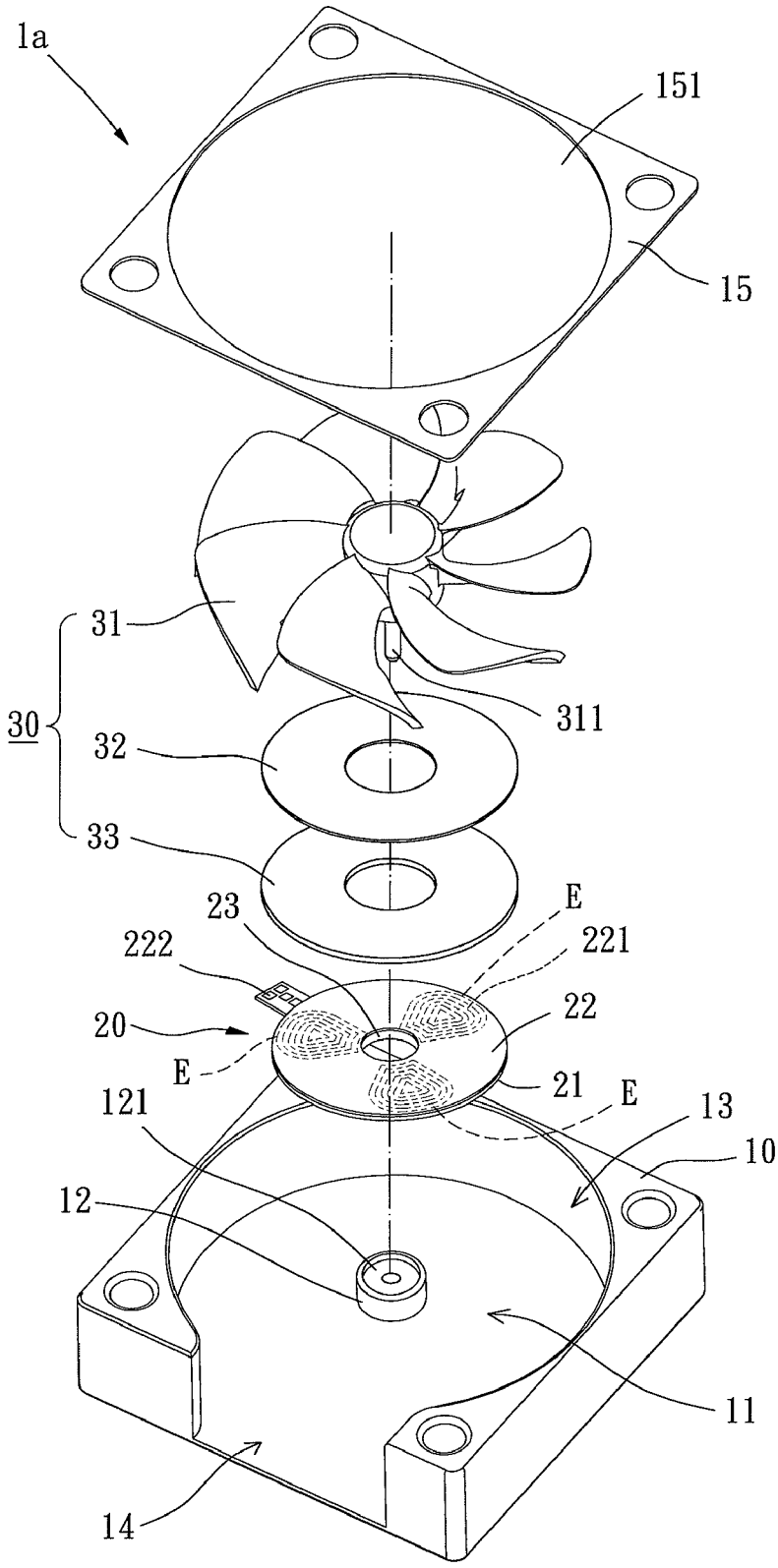
FIG. 5 is an exploded perspective view illustrating a miniature heat-dissipating fan in accordance with a first embodiment of the present invention.
Figure 6:
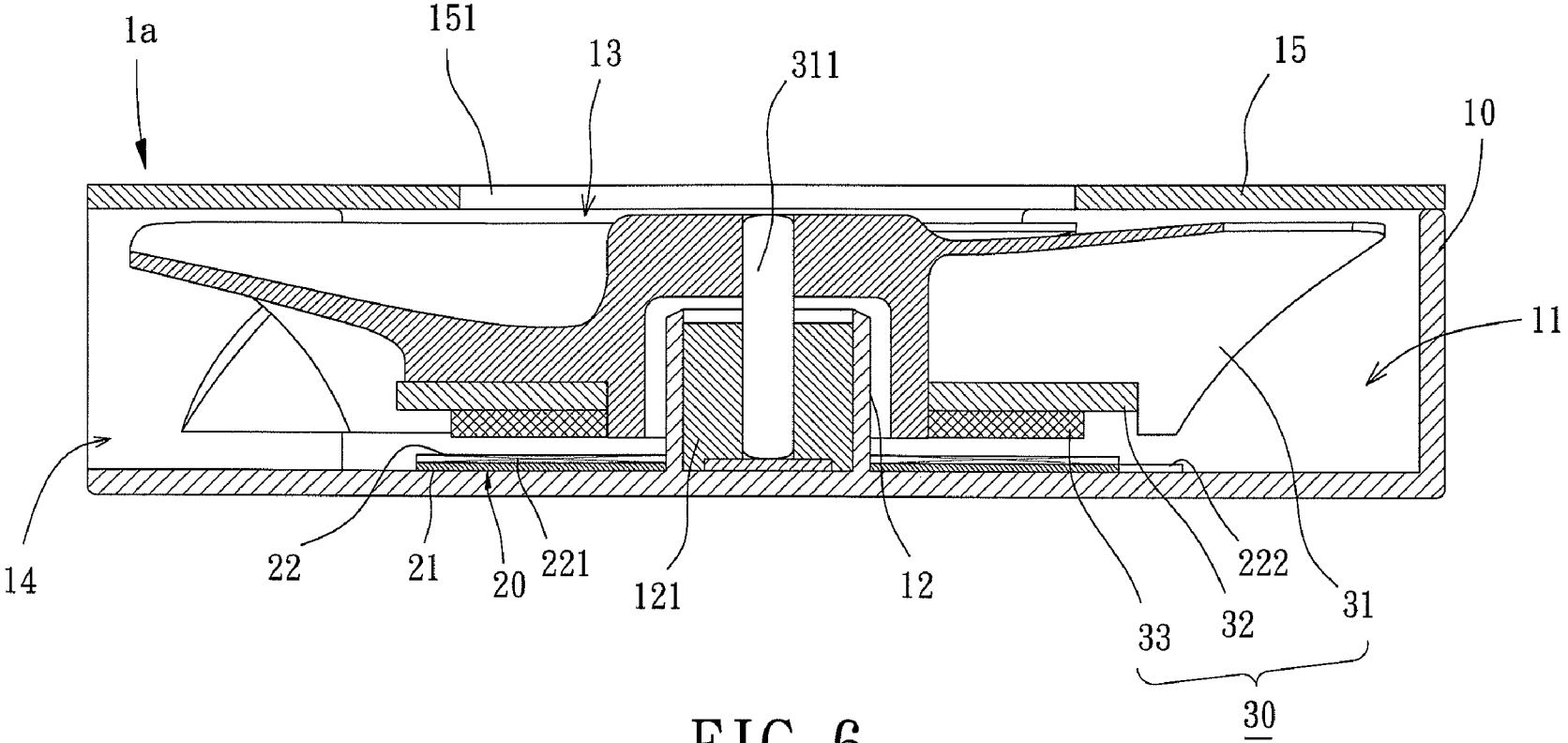
FIG. 6 is a cross sectional view illustrating the miniature heat-dissipating fan in accordance with a first embodiment of the present invention.

A miniature heat-dissipating fan of a first embodiment according to the preferred teachings of the present invention is shown in FIGS. 5 and 6 of the drawings. According to the first embodiment form shown, the miniature heat-dissipating fan designated numeral "1*a*" includes a casing 10, a stator 20 and a rotor 30.

The casing 10 defines a compartment 11 and has a shaft tube 12 in the compartment 11. The shaft tube 12 preferably receives a bearing 121. The casing 10 has an air inlet 13 and an air outlet 14 both connecting to the compartment 11. Furthermore, a lid 15 is mounted to one side of the casing 10 where the air inlet 13 is formed, with the lid 15 having a through hole 151 aligned with the air inlet 13.

The stator 20 has a first leakage flux absorber 21 made of magnetically conductive materials. Preferably, a printed circuit board is attached to a surface of the first leakage flux absorber 21, and a coil layer 22 is formed on the printed circuit board by layout. The coil layer 22 can be provided in two forms: a combination of a plurality of coils 221 and a driving circuit (not illustrated), and that of the coils 221 and a plurality of contacts 222 connecting to a driving circuit (not illustrated) through a power wire (not illustrated) for reducing size of the stator 20 as shown in FIG. 5. The stator 20 further has a hole 23 passing through the first leakage flux absorber 21 and the coil layer 22. Thus, the stator 20 can be disposed in the compartment 11 of the casing 10, with the stator 20 being mounted around the shaft tube 12 through the hole 23 and the coil layer 22 of the stator 20 facing the air inlet 13 of the casing 10.

Figure 7:
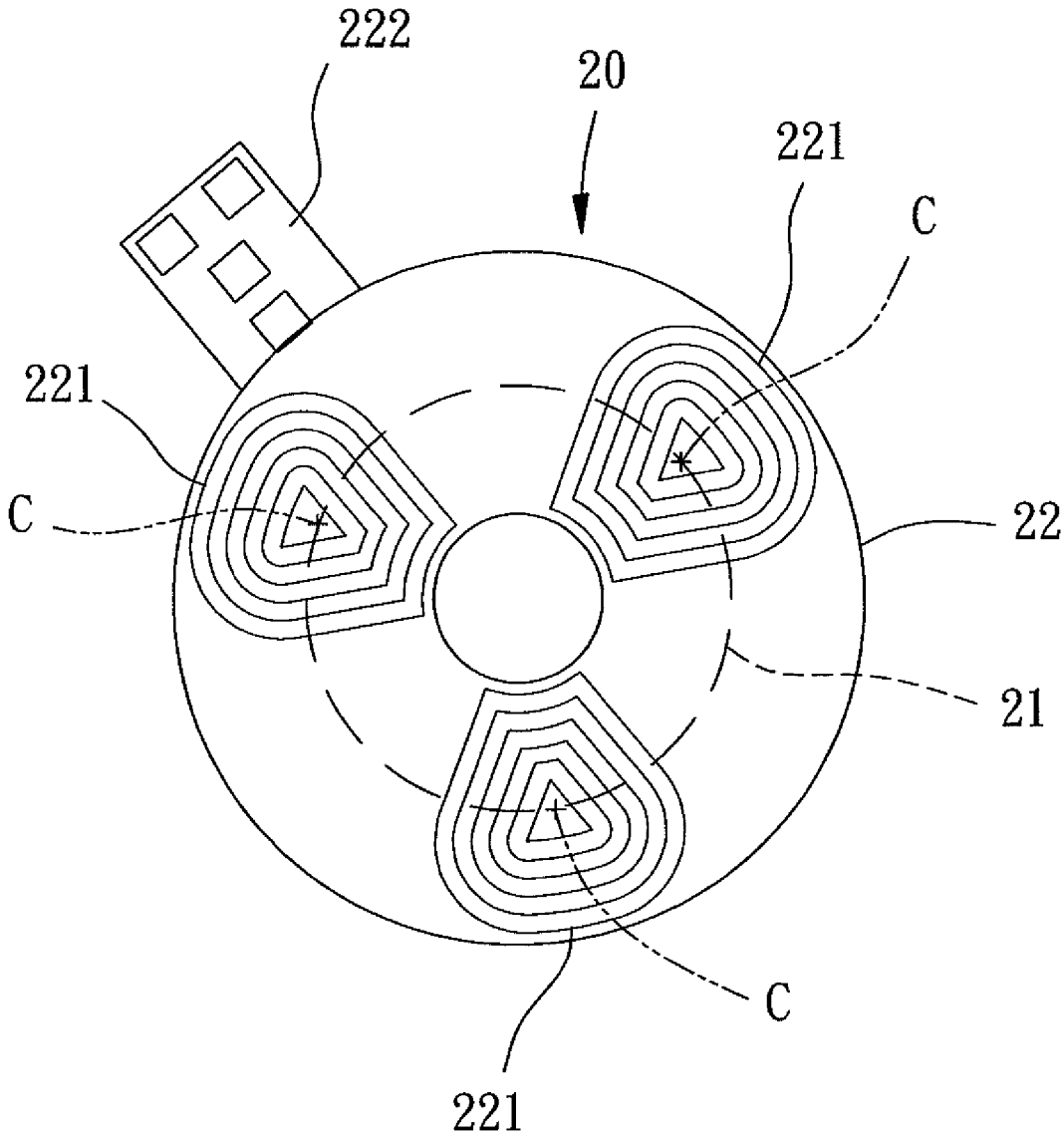
FIG. 7 is an enlarged detailed top view illustrating an arrangement of a first leakage flux absorber and a coil layer of the miniature heat-dissipating fan in accordance with the first embodiment of the present invention.

Referring again to FIG. 5, each coil 221 has an outer side "E" away from a center of the first leakage flux absorber 21, with a radius of the first leakage flux absorber 21 being larger than a distance from the center of the first leakage flux absorber 21 to the outer side "E". Hence, the first leakage flux absorber 21 is able to cover the coils 221 to provide reliable leakage flux absorbing effect. Alternatively, turning to FIG. 7, each coil 221 has a center point "C", with the radius of the first leakage flux absorber 21 being larger than a distance from the center of the first leakage flux absorber 21 to the center point "C". Therefore, the first leakage flux absorber 21 can effectively prevent magnetic flux leakage of the coils 221 and avoid electromagnetic interference. In addition, by this arrangement shown in FIG. 7, size of the first leakage flux absorber 21 is reduced to minimize dimensions and reduce weight of the miniature heat-dissipating fan "1*a*" of the present invention.

The rotor 30 includes an impeller 31 having a shaft 311, a second leakage flux absorber 32 providing leakage flux absorbing effect, and a permanent magnet 33 facing the coils 221 of the coil layer 22 of the stator 20. The second leakage flux absorber 32 and the permanent magnet 33 are firmly attached to a bottom of the impeller 31, with the permanent magnet 33 being between the second leakage flux absorber 32 and the stator 20. The shaft 311 passes through the hole 23 of the stator 20 and is rotatably inserted in the bearing 121 in the shaft tube 12, such that the impeller 31 can rotate in the compartment 11 of the casing 10.

In use, the coils 221 of the coil layer 22 of the stator 20 are provided with an electric current to generate alternative magnetic fields, and, thus, the rotor 30 with the permanent magnet 33 is driven by the alternative magnetic fields to turn. When the rotor 30 of the miniature heat-dissipating fan "1*a*" turns, the impeller 31 of the rotor 30 sucks air into the compartment 11 of the casing 10 via the air inlet 13 and output outputs air to outer spaces of the casing 10 via the air outlet 14. Therefore, the miniature heat-dissipating fan "1*a*" is able to provide a heat dissipating effect to remove heat from any type of electronic device or electronic apparatus where the miniature heat-dissipating fan "1*a*" is mounted.

The miniature heat-dissipating fan "1*a*" of the present invention is characterized in that the stator 20 has the first leakage flux absorber 21 and the coil layer 22 arranged on the first leakage flux absorber 21. By this arrangement, during rotation of the rotor 30 driven by the alternative magnet fields, the second leakage flux absorber 32 of the miniature heat-dissipating fan "1*a*" provides leakage flux absorbing effect, such that magnetic flux leakage above the coil layer 22 and the permanent magnet 33 is prevented. Besides, by the configuration of the first leakage flux absorber 21, magnetic flux, that is generated by the coil layer 22 and doesn't react with the permanent magnet 33, is intercepted and guided by the first leakage flux absorber 21 to avoid magnetic flux leakage under the coil layer 22. Thus, electromagnetic interference (EMI) will never be caused to affect the electronic device or electronic apparatus, such that normal operation of the electronic device or electronic apparatus is ensured. In addition, the coil layer 22 is directly disposed on the first leakage flux absorber 21 to form the stator 20 to simplify structure of the miniature heat-dissipating fan "1*a*" and reduce an axial thickness of the stator 20. Therefore, an overall axial thickness of the miniature heat-dissipating fan "1*a*" is reduced for the purposes of minimizing dimensions and reducing weight of the miniature heat-dissipating fan "1*a*".

Figure 8:
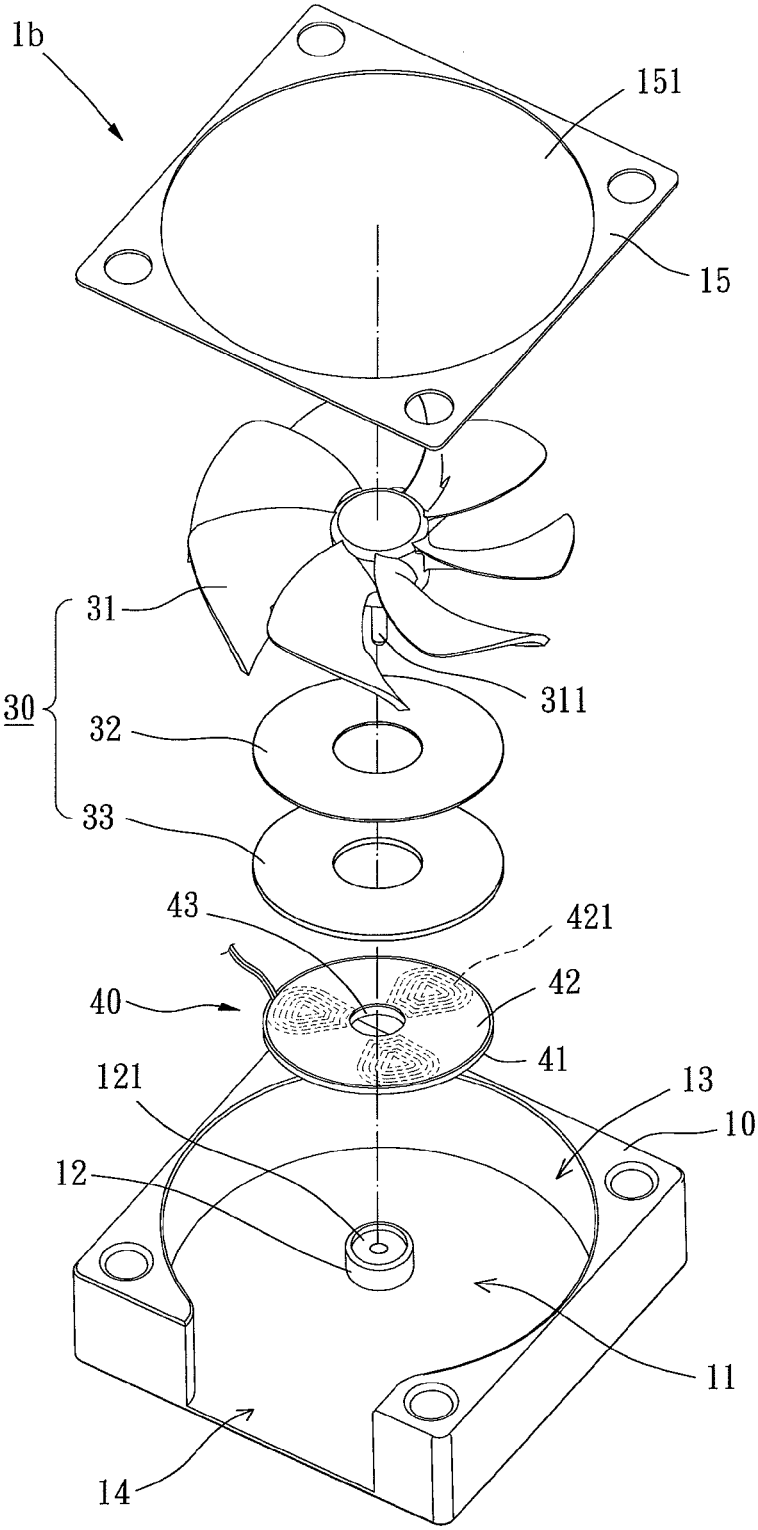
FIG. 8 is an exploded perspective view illustrating a miniature heat-dissipating fan in accordance with a second embodiment of the present invention.
Figure 9:
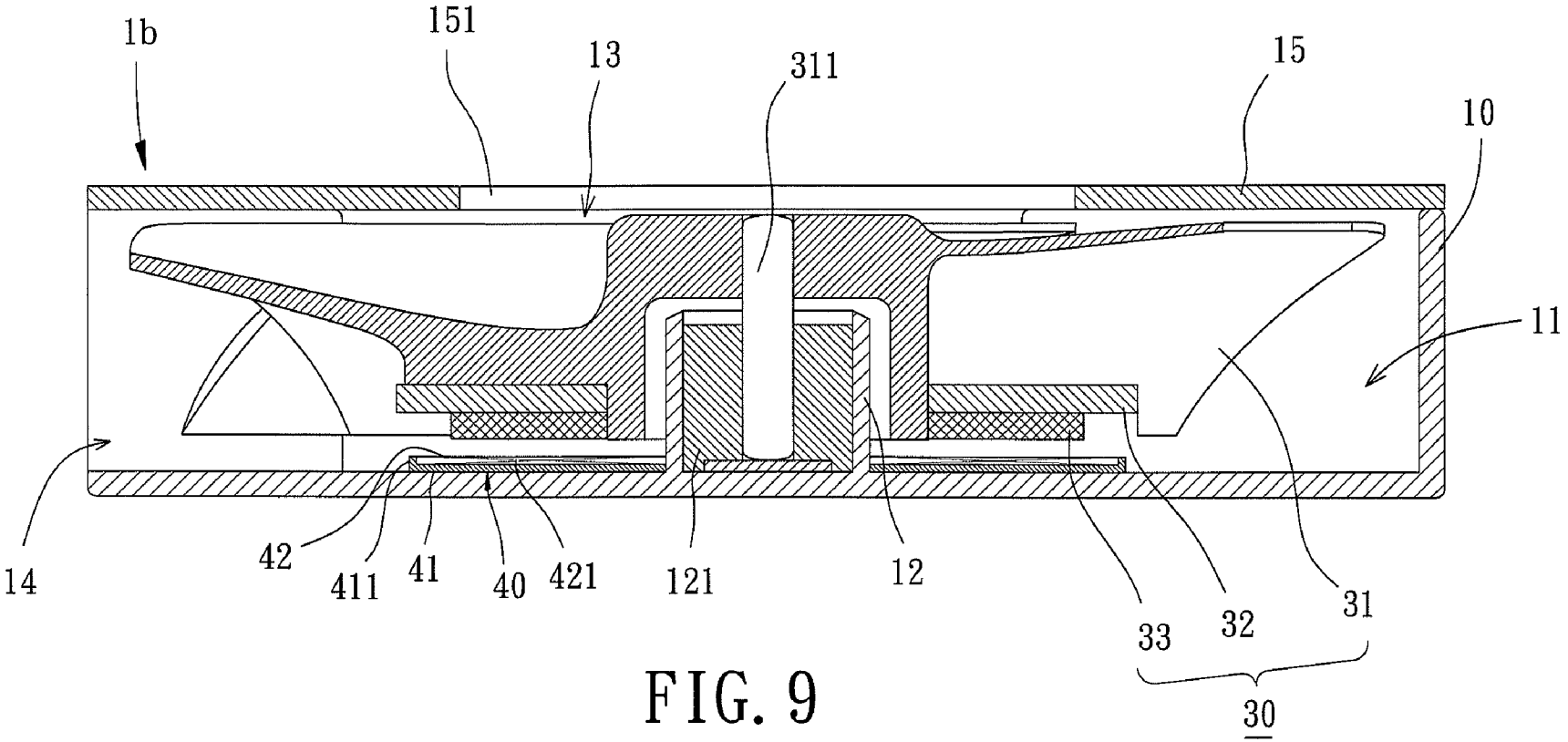
FIG. 9 is a cross sectional view illustrating the miniature heat-dissipating fan in accordance with the second embodiment of the present invention.

FIGS. 8 and 9 show a miniature heat-dissipating fan "1*b*" of a second embodiment according to the preferred teachings of the present invention. The miniature heat-dissipating fan "1*b*" includes a casing 10, a stator 40 and a rotor 30. Descriptions of the casing 10 and the rotor 30 are omitted. In detail, leakage flux absorbing effect of the stator 40 of the miniature heat-dissipating fan "1*b*" of the present invention is further enhanced. Particularly, the stator 40 includes a first leakage flux absorber 41, a coil layer 42 arranged on a surface of the first leakage flux absorber 41 and a hole 43 passing through the first leakage flux absorber 41 and the coil layer 42. The coil layer 42 has a plurality of coils 421 and a driving circuit (not illustrated). Besides, a flange 411 is formed on an outer edge of the first leakage flux absorber 41 of the stator 40, with the flange 411 extending upwards and parallel to the shaft 311 of the rotor 30 to surround and contact with an outer edge of the coil layer 42. In assembly, the stator 40 is disposed in the compartment 11 of the casing 10, with the stator 40 being mounted around the shaft tube 12 through the hole 43 and the coil layer 42 facing the air inlet 13 of the casing 10. Also, the shaft 311 passes through the hole 43 of the stator 40 and is received in the bearing 121 in the shaft tube 12.

By this configuration and arrangement of the first leakage flux absorber 41 and the second leakage flux absorber 32 of the miniature heat-dissipating fan "1*b*" of the second embodiment, magnetic flux leakage above and under the coil layer 42 and the permanent magnet 33 is also prevented effectively. Hence, electromagnetic interference (EMI) will never be caused to affect the electronic device or electronic apparatus, and an axial thickness of the stator 40 is reduced. Moreover, magnetic flux leakage around an outer edge of the coil layer 42 is prevented effectively, because the flange 411 of the first leakage flux absorber 41 surrounds and seals the outer edge of the coil layer 42 to provide reliable leakage flux absorbing effect.

Figure 10:
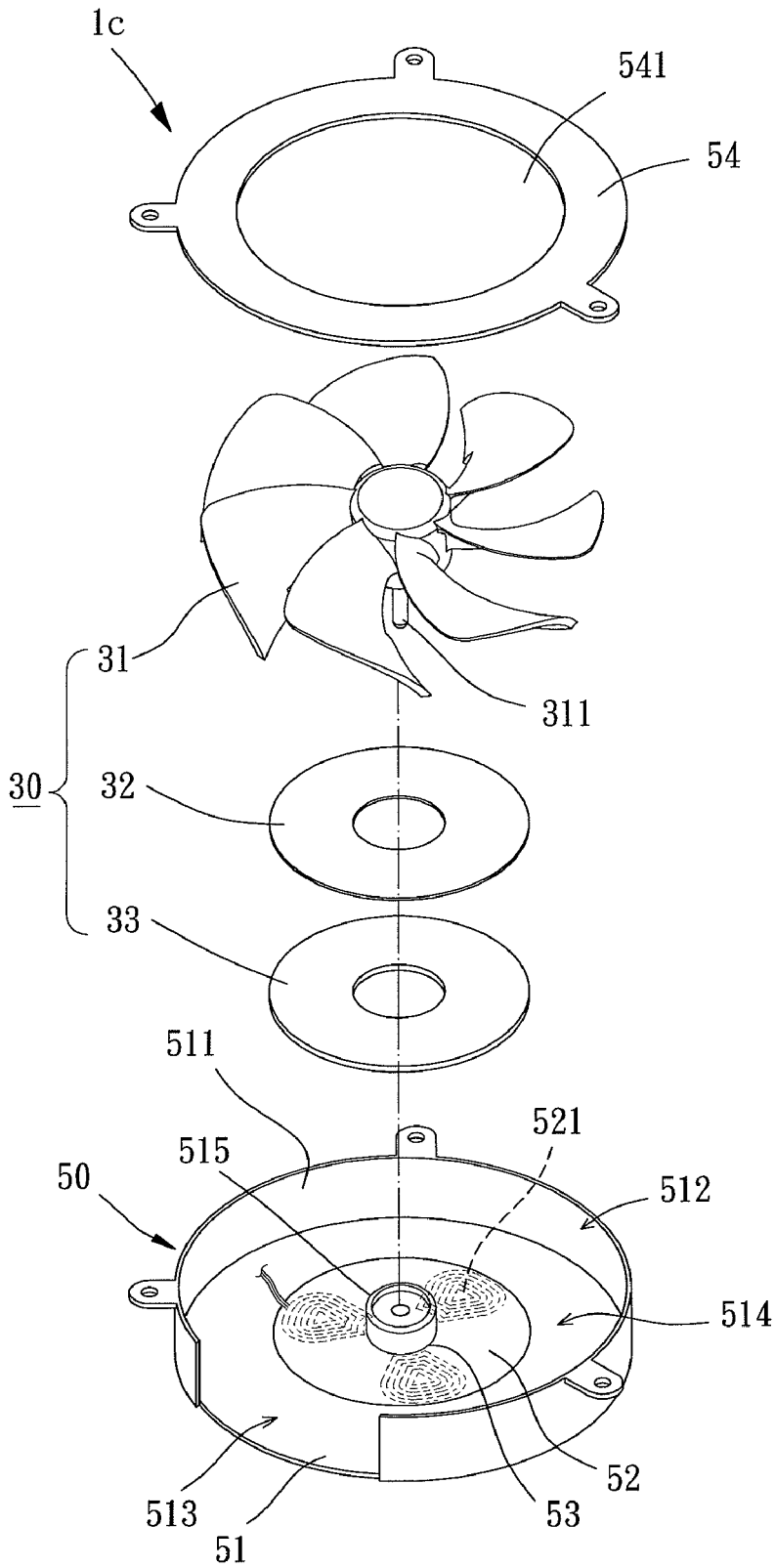
FIG. 10 is an exploded perspective view illustrating a miniature heat-dissipating fan in accordance with a third embodiment of the present invention.
Figure 11:
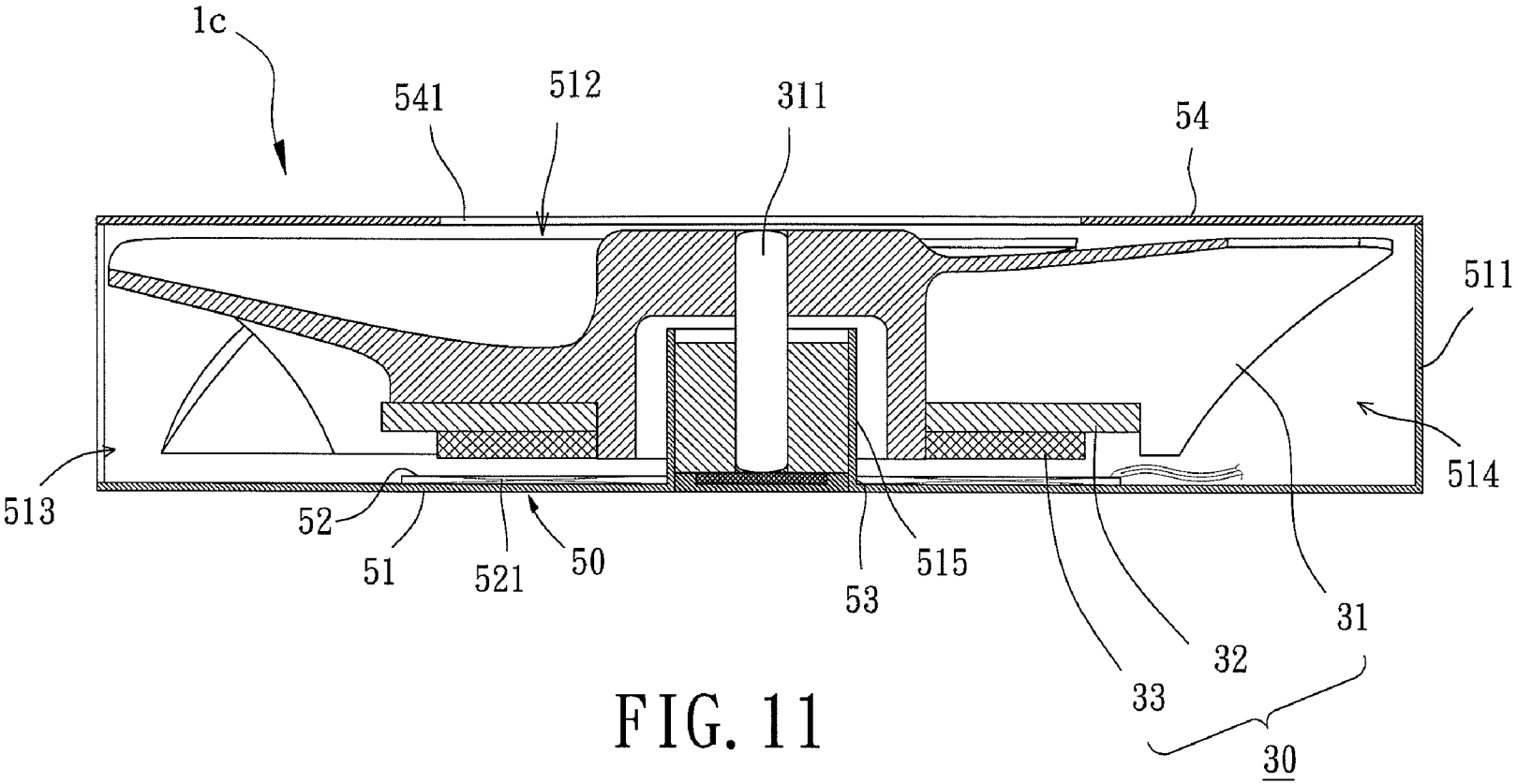
FIG. 11 is a cross sectional view illustrating the miniature heat-dissipating fan in accordance with the third embodiment of the present invention.

FIGS. 10 and 11 show a miniature heat-dissipating fan "1*c*" of a third embodiment according to the preferred teachings of the present invention. The miniature heat-dissipating fan "1*c*" includes a stator 50 and a rotor 30. Descriptions of the rotor 30 is omitted. The main difference between the third embodiment and the first two embodiments is that the casing 10 is absent from the third embodiment.

Specifically, the stator 50 also includes a first leakage flux absorber 51, a coil layer 52 arranged on the first leakage flux absorber 51 and a hole 53 passing through the first leakage flux absorber 51 and the coil layer 52. The coil layer 52 has a plurality of coils 521 and a driving circuit (not illustrated). Besides, an annular wall 511 is formed on an outer edge of the first leakage flux absorber 51 of the stator 50, with the annular wall 511 extending upwards and parallel to the shaft 311 of the rotor 30 to define an air inlet 512, an air outlet 513 and a compartment 514 where the air inlet 512 and the air outlet 513 both connect. The first leakage flux absorber 51 has a shaft tube 515 in the compartment 514. Preferably, the shaft tube 515 is integrally formed on the first leakage flux absorber 51. The coil layer 52 is mounted around the shaft tube 515 through the hole 53. The rotor 30 is received in the compartment 514 of the first leakage flux absorber 51, with the shaft 311 of the impeller 31 being inserted into the shaft tube 515 of the first leakage flux absorber 51 and the permanent magnet 33 facing the coils 521 of the coil layer 52 of the stator 50. Hence, the impeller 31 can rotate in the compartment 514 of the first leakage flux absorber 51. Furthermore, a lid 54 is mounted to one side of the first leakage flux absorber 51 where the air inlet 512 is formed, with the lid 54 having a through hole 541 aligned with the air inlet 512.

By this configuration and arrangement of the first leakage flux absorber 51 and the second leakage flux absorber 32 of the miniature heat-dissipating fan "1*c*" of the third embodiment, magnetic flux leakage above and under the coil layer 52 and the permanent magnet 33 is also prevented effectively. Hence, electromagnetic interference (EMI) will never be caused to affect the electronic device or electronic apparatus, and an axial thickness of the stator 50 is reduced. Moreover, owing to the annular wall 511 that is arranged around the coil layer 52, the first leakage flux absorber 51 is able to provide a reliable leakage flux absorbing effect. Particularly, the miniature heat-dissipating fan "1*c*" is formed without the casing 10 disclosed in the first and second embodiments of the present invention, and the first leakage flux absorber 51 of the third embodiment of the present invention still has the function of the casing 10. Therefore, a simplified structure for assembly is allowed.

As has been discussed above, the first leakage flux absorber 21, 41, 51 of the stator 20, 40, 50 and the second leakage flux absorber 32 of the rotor 30 are utilized to avoid magnetic flux leakage of the miniature heat-dissipating fan "1*a*", "1*b*", "1*c*", so that electromagnetic interference (EMI) generated from the magnetic flux leakage is further prevented. Besides, the coils 221, 421, 521 of the coil layer 22, 42, 52 are formed by layout to reduce the axial thickness of the stator 20, 40, 50. Consequently, an overall volume of the miniature heat-dissipating fan "1*a*", "1*b*", "1*c*" is reduced for the purposes of miniature design.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A miniature heat-dissipating fan comprising:

a casing defining a compartment and a shaft tube in the compartment, with the casing having an air inlet and an air outlet both connected to the compartment;

a stator disposed in the compartment of the casing and having a first leakage flux absorber, a coil layer arranged on the first leakage flux absorber, and a hole passing through the first leakage flux absorber and the coil layer, with the coil layer having a plurality of coils, wherein a flange is formed on an outer edge of the first leakage flux absorber of the stator and wherein an inner edge of the first leakage flux absorber contacts and surrounds the shaft tube, with the first leakage flux absorber having a flat receiving surface between the flange and the shaft tube;

a printed circuit board attached to the flat receiving surface of the first leakage flux absorber, with the printed circuit board contacting and surrounding the shaft tube and with the flange contacting and surrounding the printed circuit board, the coil layer being formed on the printed circuit board; and a rotor having an impeller, a second leakage flux absorber and a permanent magnet, with the impeller having a shaft passing through the hole of the stator and being rotatably inserted in the shaft tube of the casing, with both the second leakage flux absorber and the permanent magnet being attached to a bottom of the impeller.

2. The miniature heat-dissipating fan as defined in claim 1, wherein the coil layer is formed on the printed circuit board by layout.

3. The miniature heat-dissipating fan as defined in claim 2, wherein each coil has an outer side away from a center of the first leakage flux absorber, with a radius of the first leakage flux absorber being larger than a distance from the center of the first leakage flux absorber to each of the outer sides.

4. The miniature heat-dissipating fan as defined in claim 2, wherein each coil has a center point, with a radius of the first leakage flux absorber being larger than a distance from a center of the first leakage flux absorber to each of the center points.

5. The miniature heat-dissipating fan as defined in claim 2, wherein a lid is mounted to one side of the casing where the air inlet is formed, with the lid having a through hole aligned with the air inlet.

* * * * *